United States Patent [19]

Postma et al.

[11] 3,947,796

[45] Mar. 30, 1976

[54] COIL SHAPE COMPRISING AN H-SHAPED COIL CORE

[75] Inventors: Willem Johannes Postma; Hans Tielrooy; Johannes Hubertus Tobben, all of Eindhoven, Netherlands

[73] Assignee: U.S. Philips Corporation, New York, N.Y.

[22] Filed: Apr. 4, 1975

[21] Appl. No.: 565,070

[30] Foreign Application Priority Data

Apr. 24, 1974 Netherlands ..... 7405491

[52] U.S. Cl. ..... 336/192; 336/198; 336/212

[51] Int. Cl.[2] ..... H01F 27/30

[58] Field of Search ..... 336/198, 208, 192, 160, 336/212; 310/194

[56] References Cited

UNITED STATES PATENTS

| | | | |
|---|---|---|---|
| 3,354,417 | 11/1967 | Davis | 336/198 |

FOREIGN PATENTS OR APPLICATIONS

| | | | |
|---|---|---|---|
| 1,539,679 | 8/1969 | Germany | 336/192 |
| 232,060 | 2/1964 | Austria | 336/160 |
| 1,243,690 | 8/1971 | United Kingdom | 336/208 |
| 731,536 | 2/1943 | Germany | 336/208 |

*Primary Examiner*—Thomas J. Kozma
*Attorney, Agent, or Firm*—Frank R. Trifari; Bernard Franzblau

[57] ABSTRACT

A coil shape comprising:

a. an H-shaped ferromagnetic core b. a coil former of synthetic material.

The coil former is moulded about the H-shaped core and is provided with grooves such that the mechanical stresses produced by the shrinking of the coil former are completely or substantially removed.

9 Claims, 3 Drawing Figures

COIL SHAPE COMPRISING AN H-SHAPED COIL CORE

The invention relates to a coil frame, comprising, an H-shaped ferromagnetic coil core having a central connecting piece on both sides of which a leg is formed, and a coil former of synthetic material which is moulded about the said coil core and which comprises a coil can which envelops the central connecting piece, on both sides of the coil can a U-shaped trough being formed which encloses each leg of the coil core on three sides of each leg, an uninterrupted side adjoining the central connecting piece of the coil core being maintained free from synthetic material.

The moulding in of H-shaped coil cores of ceramic ferromagnetic material is known from U.S. Pat. 3,189,859. The moulded-in cores, however, are very liable to be influenced by the moulding process such that the desired magnetic properties are lost to a substantial degree. The shrinkage occurring during the cooling of the synthetic coil former will produce mechanical stresses in the enveloped core, thus giving rise to deterioration of the desired magnetic qualities and even to breaking of the coil core. Therefore, the coil former is usually made of at least two parts which are glued about the coil core. This involves an additional operation and hence additional cost.

An object of the invention is to solve the said problems and to make it possible to manufacture an inexpensive coil or transformer of good quality in large series.

To this end, the coil according to the invention is characterized in that the ends of the legs are maintained free from synthetic material, the coil can is provided with at least one groove which extends over the entire length of the coil can, and at least two grooves are provided in the troughs of synthetic material on the outside and transverse to the longitudinal direction of the legs of the coil core. The provided grooves permit non-elastic stretching in the coil former so that the stresses produced by the shrinkage of the coil former are fully or substantially removed.

The invention will be described in detail hereinafter with reference to the accompanying drawing in which FIG. 1 is a perspective view of a preferred embodiment of the coil frame according to the invention.

Figure 1:
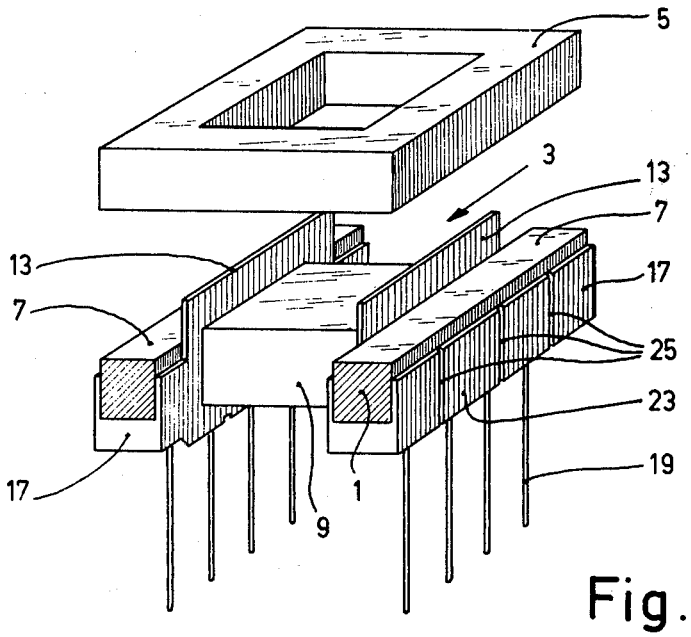

The coil frame shown in FIG. 1 comprises an H-shaped coil core 1 about which a synthetic coil former 3 is moulded and which is adapted to cooperate with a rectangular annular portion 5. The H-shaped coil core 1 comprises a central connecting piece (not visible), on both sides of which a leg 7 is formed. One or more windings can be provided about the coil former 3, the windings not being shown for the sake of clarity.

Figure 2:
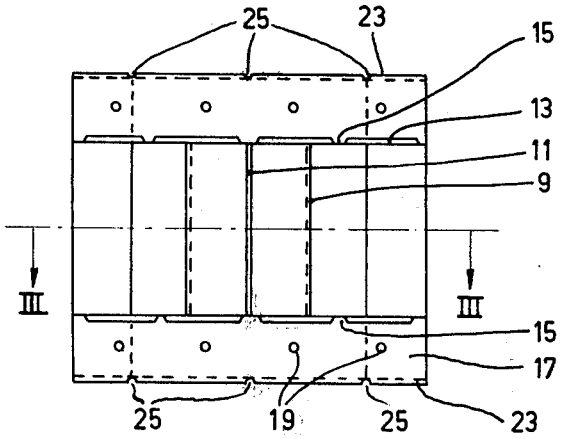
FIG. 2 is a bottom view of the embodiment shown in FIG. 1.
Figure 3:
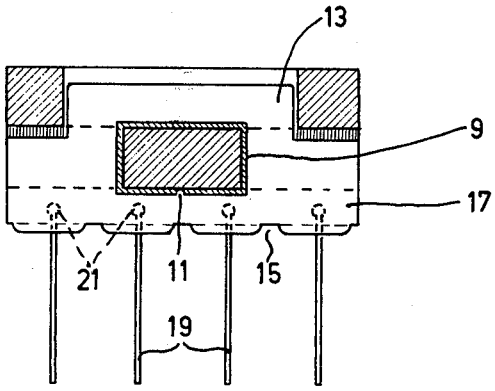
FIG. 3 is a vertical sectional view through the embodiment shown in FIG. 1.

The coil former 3 comprises a coil can 9 which is provided on its lower side with a groove 11, as shown in FIG. 2, which has been recessed as far as the coil core 1. For the benefit of the windings to be provided, the coil can 9 comprises two flanges 13 which are provided with recesses 15, as shown in FIG. 3, for the passage of connection wires.

On the same side of the coil former 3 U-shaped troughs 17 are formed on the coil can 9 which envelop the legs 7 of the H-shaped core and in which connection pins 19 are provided for connection of the connection wires of the winding (windings). The connection pins 19 are provided on one side with a head 21 which ensures proper locking in to the bottom of the U-shaped trough 17. The U-shaped trough need not cover the leg 7 as far as the non-covered side of the leg 7. The U-shaped trough has an outer side 23 in which three grooves 25 are provided.

The groove 11 prevents the occurrence of shrinkage stresses in the coil can 9 which encloses the central connecting piece of the H-shaped coil core 1.

The outer sides 23 are provided to obtain the same pressure on both sides of the legs 7 of the coil core 1 during and after the moulding in of the coil core 1, so that the risk of cracking is eliminated.

The grooves 25 are provided to prevent stresses due to shrinkage of the coil former 3 in the longitudinal direction of the coil core 1.

Therefore, the ends of the legs 7 of the coil core 1 are not enclosed by the coil former 3 either, so that the legs 7 of the coil core 1 are not clamped in the longitudinal direction.

What is claimed is:

1. A coil frame comprising an H-shaped ferromagnetic coil core having a central connecting piece on both sides of which a leg is formed, a coil former made of synthetic material which is moulded about said coil core and comprising a coil can which envelops the central connecting piece and a U-shaped trough formed on both sides of the coil can, each leg of the coil core being located within a trough so that each trough encloses a respective leg of the coil core on three sides whereby an uninterrupted side of each leg of the coil core is maintained free from synthetic material, the ends of the legs being maintained free from synthetic material, the coil can including at least one groove recessed therein and extending over the entire length of the coil can, and at least two grooves recessed in each trough of synthetic material on the outside with the grooves extending transverse to the longitudinal direction of the legs of the H-shaped coil core.

2. A coil frame as claimed in claim 1, wherein the groove in the coil can is recessed as far as the central connecting piece of the coil core.

3. A coil frame as claimed in claim 1 wherein the grooves in the outer side of the U-shaped troughs are recessed as far as the legs of the coil core.

4. A coil frame as claimed in claim 1, on which flanges are formed, wherein the groove in the coil can extends to the flanges as far as the legs of the coil core.

5. A coil core comprising an H-shaped member of ferromagnetic material having a pair of legs and a connecting cross bar member, a coil former composed of a synthetic material molded about said H-shaped member and comprising a first support member that closely envelops said cross-bar member and first and second elongate U-shaped members located on opposite sides of said first support member so as to partially enclose respective ones of said pair of legs and leaving at least one end and one surface of each leg uncovered, a groove recessed in said first support member and extending approximately parallel to the longitudinal axis of the cross bar member, a plurality of grooves recessed in one outside surface of each U-shaped member and extending transverse to the longitudinal axis of the respective leg of the H-shaped member thereby to materially reduce any mechanical stresses tending to occur in said H-shaped core during the molding process of the coil former.

6. A coil core as claimed in claim 5 wherein the coil former is formed by a molding process such that the first support member and the first and second U-shaped members together form a single integral unit in close contact with the H-shaped ferromagnetic member.

7. A coil core as claimed in claim 5 wherein said one surface of each of said legs lie in a single plane.

8. A coil core as claimed in claim 5 further comprising a polygonal ring of ferromagnetic material having two parallel legs arranged to mate with the legs of said H-shaped member along the uncovered leg surfaces thereof.

9. A coil core as claimed in claim 5 further comprising a plurality of parallel spaced electrode pins molded into said first and second elongate U-shaped members in surfaces lying in the opposite direction from said uncovered leg surfaces.

* * * * *